United States Patent [19]

Winkley

[11] 4,132,751

[45] Jan. 2, 1979

[54] CHOKE VALVE CLOSING MEANS

[75] Inventor: Jerry H. Winkley, St. Louis, Mo.

[73] Assignee: ACF Industries, Inc., New York, N.Y.

[21] Appl. No.: 831,404

[22] Filed: Sep. 8, 1977

[51] Int. Cl.[2] ..... F02M 1/10

[52] U.S. Cl. ..... 261/39 B; 236/101 C

[58] Field of Search ..... 261/39 B, 64 B; 137/79; 236/101 C

[56] References Cited

U.S. PATENT DOCUMENTS

| | | | |
|---|---|---|---|
| 1,821,014 | 9/1931 | Heitger | 261/39 B |
| 1,996,245 | 4/1935 | Hunt | 261/39 B |
| 2,262,632 | 11/1941 | Bicknell | 261/39 B |
| 2,746,439 | 5/1956 | Hunt | 261/39 B |
| 2,786,657 | 3/1957 | Sutton | 261/39 B |
| 3,685,809 | 8/1972 | Manning | 261/39 B |
| 3,920,777 | 11/1975 | Harrison et al. | 261/39 B |

*Primary Examiner*—Tim R. Miles

[57] ABSTRACT

A carburetor for an internal combustion engine has an air passage through which air is drawn into the engine, an unbalanced choke valve positioned in the air passage and movable between a closed position and a fully open position, a thermostatic device responsive to engine temperature for urging the choke valve closed with a force which diminishes as engine temperature increases, and a suction motor responsive to engine vacuum for urging the choke valve open with a force which increases as engine vacuum increases. The position of the choke valve at any time is determined by the net effect of the abovesaid forces. A load is applied to the choke valve when it is closed to dampen its movement during cranking of the engine to facilitate starting. Further, the load forces the choke valve closed when it is between its closed position and a predetermined position intermediate its closed and fully open positions. The load has no effect on the position of the choke valve when its position is between the predetermined intermediate position and the fully open position of the choke valve. The closing of the choke valve facilitates restarting of the engine when it is shut down.

3 Claims, 4 Drawing Figures

CHOKE VALVE CLOSING MEANS

BACKGROUND OF THE INVENTION

This invention relates to carburetors with automatic chokes and more particularly to apparatus for closing a choke valve during starting of an engine.

Carburetors with automatic chokes include a thermostatic element which holds the carburetor's choke valve closed during cold start of an engine and a vacuum motor which opens the choke valve when the engine starts. During cold start of the engine, the choke valve tends to flutter, which varies the air-fuel ratio of the mixture supplied to the engine to start it. This may lengthen the time required to start the engine, cause it to stall, and increase engine emissions during starting. When the engine is running and warms up, the closing force exerted by the thermostatic element lessens and the choke valve moves to a fully open position. After the engine is shut off, the thermostatic element gradually returns the choke valve to its closed position. When the engine is restarted after a period of shut off, the choke valve may not be fully closed but rather at some position intermediate its open and closed positions. With the choke open, an undesirably lean air-fuel mixture is supplied to the engine making it difficult to restart.

SUMMARY OF THE INVENTION

Among the several objects of the present invention may be noted the provision of means for applying a load to the choke valve of a carburetor; the provision of such means which dampens movement of a closed choke valve during cranking of the engine so that a uniform air-fuel mixture is supplied to the engine to facilitate starting of the engine; the provision of such means for closing the choke valve prior to restart of the engine so that an appropriately rich air-fuel mixture is supplied to the engine to facilitate restarting of the engine; and the provision of such means for reducing the time to start an engine and engine emissions produced during starting.

Briefly, the present invention is for an improvement in a carburetor for an internal combustion engine, the carburetor having an air passage, an unbalanced choke valve positioned in the air passage, a thermostatic device responsive to engine temperature for urging the choke valve closed with a force which diminishes as engine temperature increases, and a suction motor responsive to engine vacuum for urging the choke valve open with a force which increases as the engine vacuum increases, the position of the choke valve at any time being determined by the net effect of the abovesaid forces. The improvement comprises means for applying a load to the choke valve when it is closed to dampen its movement during cranking of the engine to facilitate starting thereof. The load means further forces the choke valve closed when it is between its closed position and a predetermined position intermediate its closed and fully open positions. The loading means has no effect on the position of the choke valve when its position is between the predetermined intermediate position and the fully open position of the choke valve. The closing of the choke valve facilitates the restarting of the engine when it is shut down. Other objects will be in part apparent and in part pointed out hereinafter.

BRIEF DESCRIPTION OF THE DRAWINGS

Corresponding reference characters indicate corresponding parts throughout the several views of the drawings.

DESCRIPTION OF A PREFERRED EMBODIMENT

Figure 1:
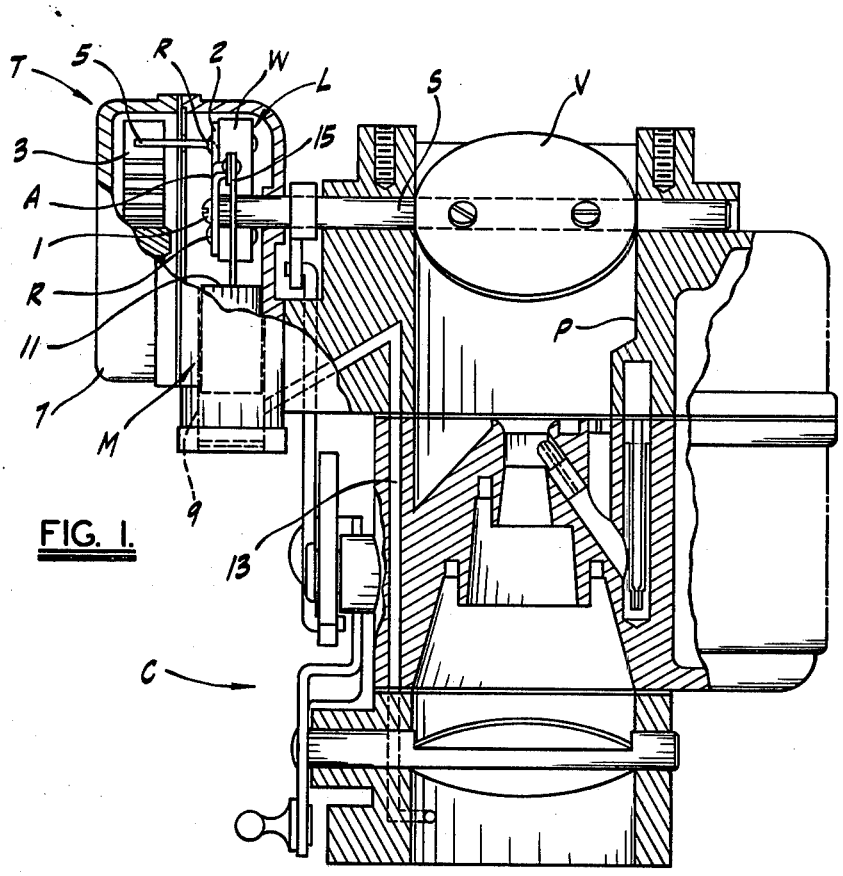
FIGS. 1 and 2 are respective front and side elevations, partly in section, of a carburetor having a choke valve and means of the present invention for applying a load to the choke valve.

Referring now to the drawings, a carburetor C for an internal combustion engine (not shown) has an air passage P through which air is drawn into the engine. An unbalanced choke valve V is positioned in air passage P and is movable between a closed position (see FIG. 2) in which flow of air into the air passage is substantially blocked and a fully open position in which flow of air into the air passage is substantially uninterrupted. Choke valve V is mounted on a rotatable shaft S which has a plate 2 secured to one end as, for example, by a screw 1. Plate 2 extends perpendicular to shaft S.

Figure 2:
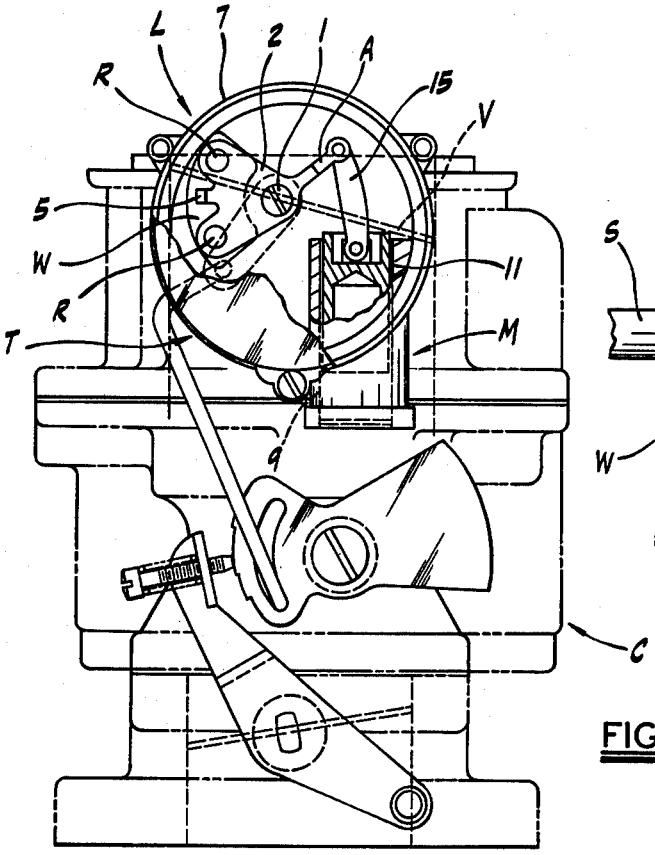
Figure 4:
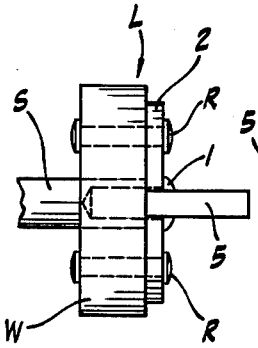
FIG. 4 is a top plan view of the plate and weight shown in FIG. 3.

A thermostatic device T is responsive to the temperature of the engine for urging choke valve V to its closed position. The thermostatic device includes, for example, a coil 3 of two dissimilar metals bonded together which reacts to the heat from the engine manifold. One end of the coil is fixed and the free end of the coil moves according to changes in the engine's temperature. Plate 2 has an outwardly projecting tang 5 and the free end of coil 3 is formed to contact the tang and exert a force on shaft S to rotate the shaft counterclockwise as shown in FIG. 2 to close choke valve V. As the temperature of the engine increases, the free end of coil 3 moves clockwise, and the counterrotative force on shaft S decreases. As shown in FIGS. 1 and 2, coil 3 is enclosed in a housing 7 to which air from the engine is supplied, the temperature of air corresponding to the temperature of the engine. Thermostatic devices such as that above described are well known in the art. Further, it will be understood that a diaphragm device responsive to engine temperature may be used instead of the device described above.

A suction motor M is responsive to the engine vacuum for urging choke valve V to its fully open position. The suction motor is comprised of a cylinder 9 and a piston 11 slidable in the cylinder. A vacuum signal from the engine is supplied to cylinder 9 via a passage 13 formed in carburetor C and the piston moves in the cylinder in response to the magnitude of this vacuum signal, all as is well known in the art. Plate 2 has an extension or arm A (see FIGS. 1 and 2) and piston 11 is connected to the arm by a link 15. Movement of piston 11 in cylinder 9 in response to engine vacuum exerts a force on choke valve V, via link 15 and choke shaft S, to move the choke valve in a clockwise direction, as shown in FIG. 2, to its fully open position. This force increases as engine vacuum increases. Since the force exerted on choke valve V by thermostatic device T is opposite in direction to the force exerted on the choke valve by suction motor M, the position of the choke valve at any time is determined by the net effect of these forces.

Figure 3:
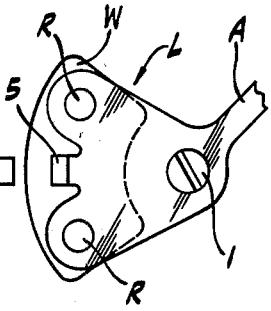
FIG. 3 is a front elevation of a plate secured to a shaft on which the choke valve is mounted, a load weight of the invention being secured to the plate.

Means, generally designated L, applys a load to choke valve V, when it is closed, to dampen movement of the choke valve, during cranking of the engine. This facilitates starting of the engine. The means comprises a weight W secured to plate 2, as for example, by rivets R. As particularly shown in FIG. 3, weight W has an annular segmental shape to conform to the shape of plate 2. It will be understood that the weight may have other shapes and may be secured to plate 2 by other means of attachment. Further, weight W may be of lead, sintered bronze or other suitably dense material and the weight of weight W is between approximately one-half ounce (12 grams) and approximately one and one-half ounces (36 grams).

During cranking of the engine, with choke valve V closed, the weight W dampens movement of the choke valve to reduce the amount of choke valve flutter, i.e. breathing. This allows a uniformly rich air-fuel mixture to be supplied to the engine for quicker engine starting. It has been experimentally shown that the inclusion of weight W to the choke valve, as described, reduces engine starting time by up to 2–3 seconds. Also, the tendency for the engine to stall is reduced and a reduction in engine emissions is achieved.

When the engine starts, the vacuum signal supplied to suction motor M results in choke valve V moving from its closed position to a predetermined position intermediate its closed and fully open positions, this intermediate position being referred to as "choke break". As the engine warms up, the force exerted on the choke valve by thermostatic device T weakens and the choke valve moves to its fully open position. Weight W is designed so as to have a neutral effect on the choke valve during this movement from choke break to fully open, i.e. it presents no load on the choke valve tending to move it one direction or the other. If the engine is shut off, no force is exerted on the choke valve by suction motor M and, as the engine cools, the force exerted on the choke valve by thermostatic device T moves the choke valve toward its closed position. When the choke valve passes its choke break position, weight W exerts a counterclockwise rotational force on the choke valve forcing it closed. Thus, when the engine is restarted, the choke valve is closed rather than at some open position. This results in a sufficiently rich mixture being supplied to the engine to facilitate restarting of the engine, i.e. enable the engine to start quicker and not stall.

In view of the above, it will be seen that the several objects of the invention are achieved and other advantageous results attained.

As various changes could be made in the above constructions without departing from the scope of the invention, it is intended that all matter contained in the above description or shown in the accompanying drawings shall be interpreted as illustrative and not in the limiting sense.

I claim:

1. In a carburetor for an internal combustion engine, said carburetor having an air passage through which air is drawn into the engine, an unbalanced choke valve positioned in said air passage and movable between a closed position in which flow of air into said air passage is substantially blocked and a fully open position in which flow of air into said air passage is substantially uninterrupted, said choke valve being mounted on a rotatable shaft having a plate secured to one end thereof, a thermostatic device responsive to the engine temperature for urging said choke valve toward its closed position with a force which diminishes as engine temperature increases, a suction motor adapted to respond to engine vacuum for urging said choke valve toward its fully open position with a force which increases as engine vacuum increases, said thermostatic device and said suction motor exerting forces on said plate to respectively urge said choke valve toward its closed and fully open position and the position of said choke valve at any time being determined by the net effect of the abovesaid forces, the improvement comprising means for applying a load to said choke valve when it is closed to dampen its movement during cranking of said engine thereby to facilitate starting thereof, said load applying means including a weight having an annular segmental shape, said weight exerting a force on said plate to force said choke valve closed when its position, as determined by the aforesaid forces, is between its closed position and a predetermined position intermediate said closed and said fully open positions, said weight having a neutral effect on said choke valve when its position is between said predetermined intermediate position and the fully open position thereof, the closing of said choke valve facilitating restarting of said engine when it is shut off.

2. The improvement as set forth in claim 1 wherein said weight weighs between approximately one-half ounce and one and one-half ounces.

3. The improvement as set forth in claim 1 wherein said load applying means further includes means for attaching said weight to said plate.

* * * * *